US008430395B2

(12) United States Patent
Peters et al.

(10) Patent No.: US 8,430,395 B2
(45) Date of Patent: Apr. 30, 2013

(54) PICK UNIT

(75) Inventors: Ken Peters, Dundee (GB); Gordon Burke, Angus (GB); Kevin Leeper, Angus (GB)

(73) Assignee: NCR Corporation, Duluth, GA (US)

( * ) Notice: Subject to any disclaimer, the term of this patent is extended or adjusted under 35 U.S.C. 154(b) by 53 days.

(21) Appl. No.: 12/946,972

(22) Filed: Nov. 16, 2010

(65) Prior Publication Data

US 2012/0119433 A1 May 17, 2012

(51) Int. Cl.
*B65H 1/00* (2006.01)

(52) U.S. Cl.
USPC ..... 271/145; 271/181; 194/206; 194/207; 194/350; 235/379

(58) Field of Classification Search ..... 271/181, 271/180, 177, 145; 194/206, 207, 350; 235/379; 109/45, 47
See application file for complete search history.

(56) References Cited

U.S. PATENT DOCUMENTS

| | | | | |
|---|---|---|---|---|
| 4,325,277 | A * | 4/1982 | Uchida et al. | 83/205 |
| 5,411,249 | A * | 5/1995 | Zouzoulas | 271/181 |
| 6,619,461 | B2 * | 9/2003 | Saltsov et al. | 194/317 |
| 6,651,796 | B2 * | 11/2003 | Chou | 194/350 |
| 6,851,540 | B2 * | 2/2005 | Chou | 194/206 |
| 7,222,712 | B2 * | 5/2007 | Liu et al. | 194/350 |
| 7,841,459 | B2 * | 11/2010 | Isobe et al. | 194/206 |
| 2001/0017276 | A1 * | 8/2001 | Yasuda et al. | 209/534 |
| 2011/0114441 | A1 * | 5/2011 | Seki et al. | 194/206 |

* cited by examiner

*Primary Examiner* — Luis A Gonzalez
(74) *Attorney, Agent, or Firm* — Paul W. Martin

(57) ABSTRACT

A pick unit is described. The pick unit comprises: a frame and a picking assembly. The frame comprises (i) one or more guides for receiving a currency cassette, (ii) a tortuous pathway for guiding and supporting a cam follower, and (iii) a detent. The picking assembly comprises: (i) a guide edge configured to abut the detent when the picking assembly is moved to an initial alignment position, (ii) a cam follower configured to align with the pathway when the removable picking assembly is moved from the initial alignment position to an engagement position, and (iii) a gear train configured to engage with an upper gear external to the pick unit when the removable picking assembly is moved to an engaged position at which the cam follower has reached an end of the tortuous pathway.

14 Claims, 9 Drawing Sheets

FIG. 9
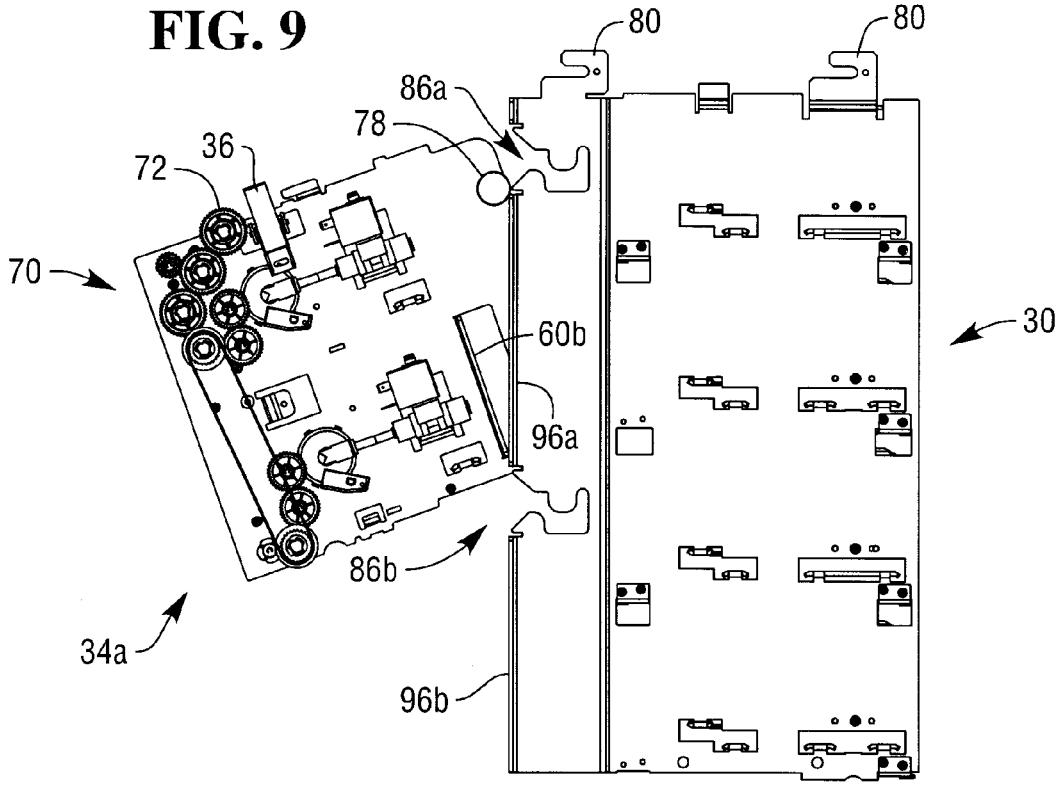
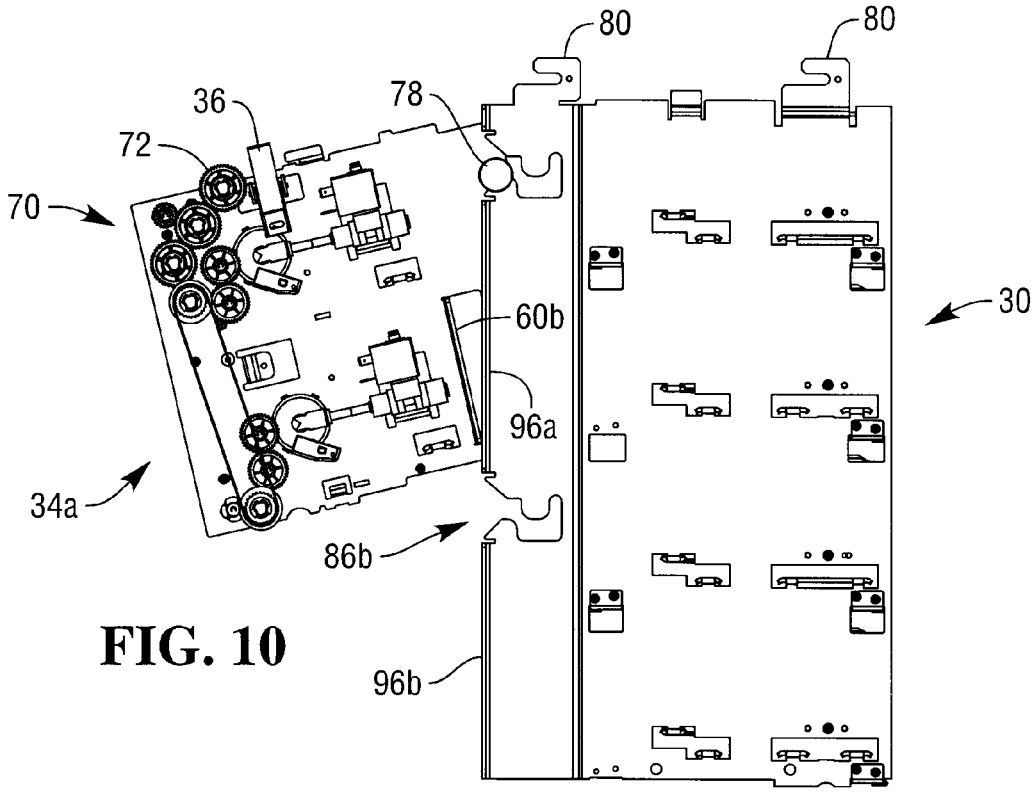
FIG. 10

PICK UNIT

FIELD OF INVENTION

The present invention relates to improvements in or relating to a pick unit.

BACKGROUND OF INVENTION

A pick unit is part of a dispenser module, which is typically located in a self-service terminal (SST). A dispenser module typically includes a presenter unit for presenting picked media items to a customer, and one or more pick units, coupled to the presenter unit, for picking individual media items from one or more storage areas in the dispenser, and for transporting the picked media items to the presenter unit.

Dispenser modules are commonly used in automated teller machines (ATMs) to dispense media items to customers. These media items are typically banknotes, but may comprise stamps, coupons, passes, or the like.

Banknote dispensers (commonly referred to as currency dispensers) typically include a removable currency cassette slidably located within each pick unit.

Each currency pick unit comprises one or more pick modules. For example, a four-high pick unit may comprise two two-high pick modules coupled together. A two-high pick module refers to a module having two picking mechanisms (one above the other). A two-high pick unit may comprise a two-high pick module.

Each picking mechanism comprises (i) a picking end, which removes media items from a cassette, and (ii) a loading end opposite the picking end. A currency cassette is inserted into, and removed from, the loading end.

Picking media items from a cassette is a complex electromechanical operation, and the picked media items are prone to jamming. Thus, the picking operation accounts for a high percentage of dispenser failures. This means that service personnel have to replace pick units quite frequently. Pick units are relatively large and heavy, so replacing pick units requires the service personnel to take a large item (one or more spare pick units or pick modules) to an ATM site in case the pick unit (or a pick module within the pick unit) needs replaced. The size and weight of a pick unit (or pick module) means that the replacement operation is quite time consuming and physically difficult for service personnel to perform.

It would be advantageous to be able to obviate or mitigate one or more of these disadvantages or other disadvantages associated with prior art pick units and pick modules.

SUMMARY OF INVENTION

Accordingly, the invention generally provides methods, systems, and apparatus for an improved pick unit comprising a fixed portion and a picking assembly removably coupled thereto, so that the picking assembly can be replaced without having to replace the fixed portion.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise.

Any claim corresponding to one aspect should not be construed as incorporating any element or feature of the other aspects unless explicitly stated in that claim.

According to a first aspect there is provided a pick unit comprising:

a frame comprising opposing sidewalls, and defining: (i) one or more guides for receiving a currency cassette, (ii) a tortuous pathway for guiding and supporting a cam follower, and (iii) a detent;

a picking assembly for removably coupling to the frame, the picking assembly comprising: (i) a guide edge configured to abut the detent when the picking assembly is moved to an initial alignment position, (ii) a cam follower configured to align with the pathway when the removable picking assembly is moved from the initial alignment position to an engagement position, and (iii) a gear train configured to engage with an upper gear external to the pick unit when the removable picking assembly is moved to an engaged position at which the cam follower has reached an end of the tortuous pathway.

The tortuous pathway may define an underpass to move the gear train below the upper gear then an upright passage to move the gear train upwards and into engagement with the upper gear.

The tortuous pathway may be configured to support the removable picking assembly via the cam follower when the removable picking assembly is in the engagement position.

The tortuous pathway may comprise a hook shape.

The removable picking assembly may further comprise one or more latches for coupling to an external unit above the pick unit. The external unit may comprise another pick unit or a presenter unit. The one or more latches may comprise over-center toggle latches.

The frame may define apertures which, when the removable picking assembly is moved to the engaged position, are in registration with apertures on the removable picking assembly, thereby allowing threaded fixtures (such as screws or bolts) to secure the removable picking assembly to the frame. The frame apertures may be threaded.

The cam follower may comprise a stud. The stud may comprise a mushroom stud defining a stem dimensioned to be accommodated within the tortuous pathway, and a flange larger than the tortuous pathway to retain the stem within the tortuous pathway.

The frame may include a vacuum generator. Alternatively, a vacuum generator may be located on an external unit (such as a presenter unit).

The frame may include one or more frame pipes. The one or more frame pipes may include sealable couplings for connecting to other pipes and also for connecting to a vacuum generator.

The removable picking assembly may further comprise a vacuum pick arm, a vacuum pipe in fluid communication with the vacuum pick arm, and a vacuum coupling for connecting the vacuum pipe to one of the frame pipes. This allows a vacuum generator to convey reduced pressure to the vacuum pick arm to enable media items to be picked from a storage container mounted in the frame. Alternatively, the removable picking assembly may comprise a friction pick roller. Where a friction pick roller is used, no vacuum pipes or vacuum generator would be required.

The storage container may comprise a currency cassette.

The removable picking assembly may comprise a plurality of vacuum pick arms. For example, a removable picking assembly may comprise two vacuum pick arms, each vacuum pick arm being aligned with a currency cassette, so that a single picking assembly can pick banknotes from either of two currency cassettes.

The removable picking assembly may further comprise one or more tines engagable with a currency cassette loaded into the frame. The tines may raise a shutter in the currency cassette when the currency cassette is inserted into the pick unit.

According to a second aspect there is provided a media dispenser including the pick unit according to the first aspect.

The media dispenser may include a presenter unit having a circuit board; the frame may further comprise a first electrical connection comprising a plurality of cables routed from the circuit board; and the removable picking assembly may further comprise a second electrical connection, interengagable with the first electrical connection, so that electrical power and data can be routed between the removable picking assembly and the presenter unit.

According to a third aspect there is provided a self-service terminal including the media dispenser according to the second aspect.

According to a fourth aspect there is provided a pick unit comprising:

a frame including a vacuum feed pipe;

a picking assembly removably coupled to the frame and including vacuum pipes for removably coupling to the vacuum feed pipe; so that the picking assembly can be removed and replaced without having to remove the frame.

The frame may define a cam track. The cam track may be in the form of a non-straight pathway, including a raised projection near an entrance thereto.

According to a fifth aspect there is provided a method of moving a picking assembly into engagement with a frame to provide a pick unit, the method comprising:

supporting a cam follower located on the picking assembly to prevent the picking assembly from falling downwards or backwards; and guiding the cam follower along a non-straight path to move the picking assembly below a gear located on an external unit and then up into engagement with the gear to enable the picking assembly to receive rotary motion therefrom.

According to a sixth aspect there is provided a removable picking assembly for a pick unit, the picking assembly comprising:

(i) a guide edge configured to abut a detent when the picking assembly is moved to an initial alignment position, (ii) a cam follower configured to align with a pathway on the pick unit when the removable picking assembly is moved from the initial alignment position to an engagement position, and (iii) a gear train configured to engage with an upper gear external to the pick unit when the picking assembly is moved to an engaged position at which the cam follower has reached an end of the pathway.

The gear train may comprise a transfer gear to receive rotational power from the upper gear. The gear train may further comprise a power take-off gear to impart rotational power to any transfer gear on a removable picking assembly located beneath the picking assembly.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

BRIEF DESCRIPTION OF THE DRAWINGS

FIGS. 7 to 13 are schematic side views illustrating various stages of the removable two-high picking assembly of FIG. 4 engaging with the frame of FIG. 6.

Figure 1:
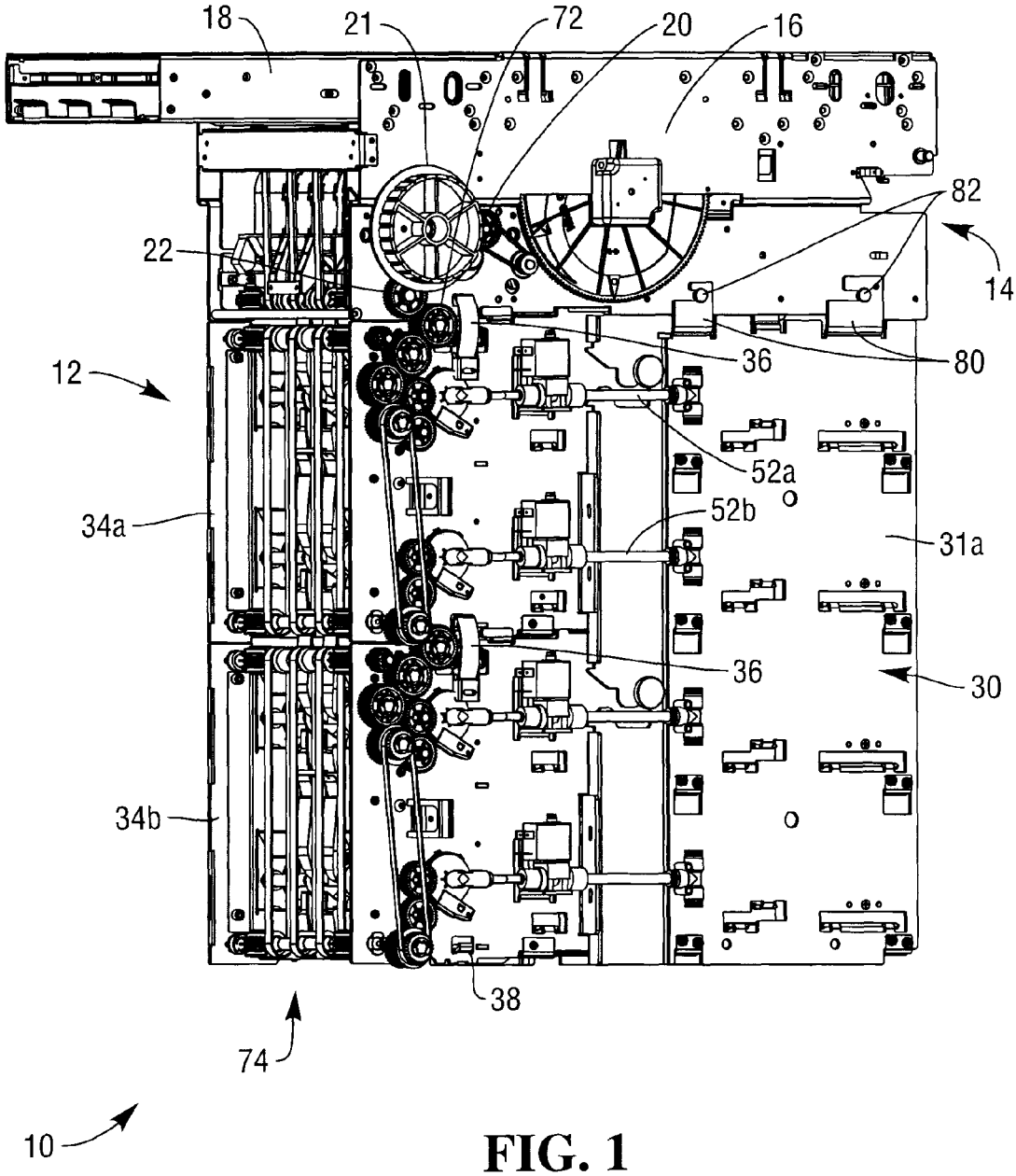
FIG. 1 is a schematic front right perspective view of a media dispenser including a four-high pick unit according to one embodiment of the present invention.

It should be appreciated that some of the drawings provided are based on computer renderings from which actual physical embodiments can be produced. As such, some of these drawings contain intricate details that are not essential for an understanding of these embodiments but will convey useful information to one of skill in the art. Therefore, not all parts shown in the drawings will be referenced specifically. Furthermore, to aid clarity and to avoid numerous leader lines from cluttering the drawings, not all reference numerals will be shown in all of the drawings. In addition, some of the features may be removed from some views to further aid clarity.

DETAILED DESCRIPTION

Figure 2:
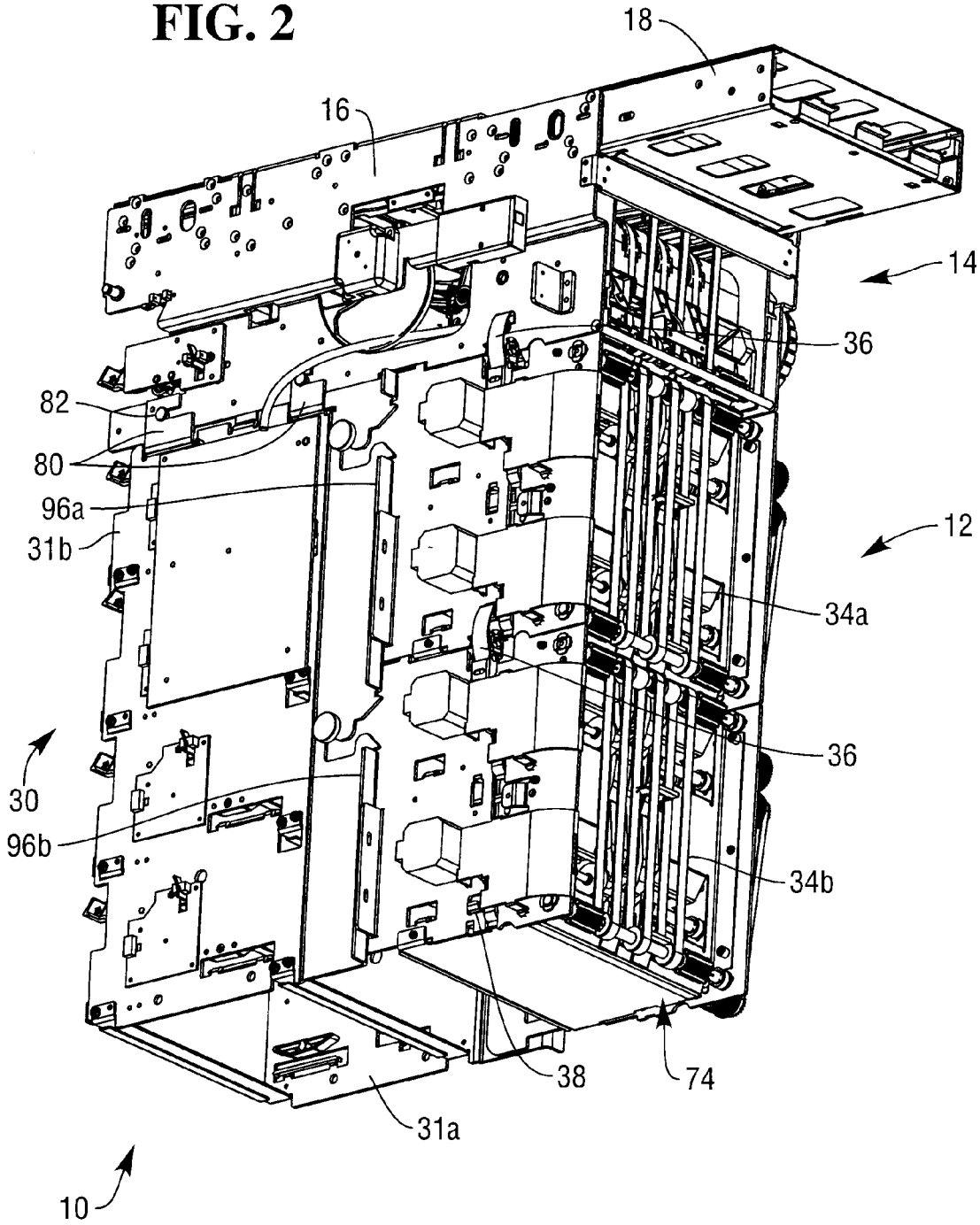
FIG. 2 is a schematic front left perspective view of the media dispenser of FIG. 1.

Reference is first made to FIGS. 1 and 2, which are schematic front perspective views of a media dispenser 10 (in the form of a currency dispenser) including a four-high pick unit 12 according to one embodiment of the present invention, and a media presenter 14 (in the form of a banknote presenter) located above, and coupled to, the four-high pick unit 12.

The banknote presenter 14 comprises a body 16 and a nose 18 extending therefrom. The body 16 comprises sheet metal enclosing various belts and skid plates (as is known in the art) to collate banknotes received individually from the four-high pick unit 12, and to present the collated banknotes as a bunch via the nose 18.

The body 16 also comprises a main motor (not shown) and a main gear 20 for providing power for mechanical devices (such as belts and pulleys) within the banknote dispenser 10 (both the banknote presenter 14 and the four-high pick unit 12). The main gear 20 rotates a hand gear 21 (so called because it can be rotated by hand by a service engineer when the power to the banknote presenter 14 is turned off), which rotates a transfer gear 22, which is used to transfer rotary power to the four-high pick unit 12.

The body 16 also comprises a vacuum pump (not shown) for generating low pressure and a vacuum source pipe (not shown) in fluid communication with the vacuum pump (not shown).

Figure 3:
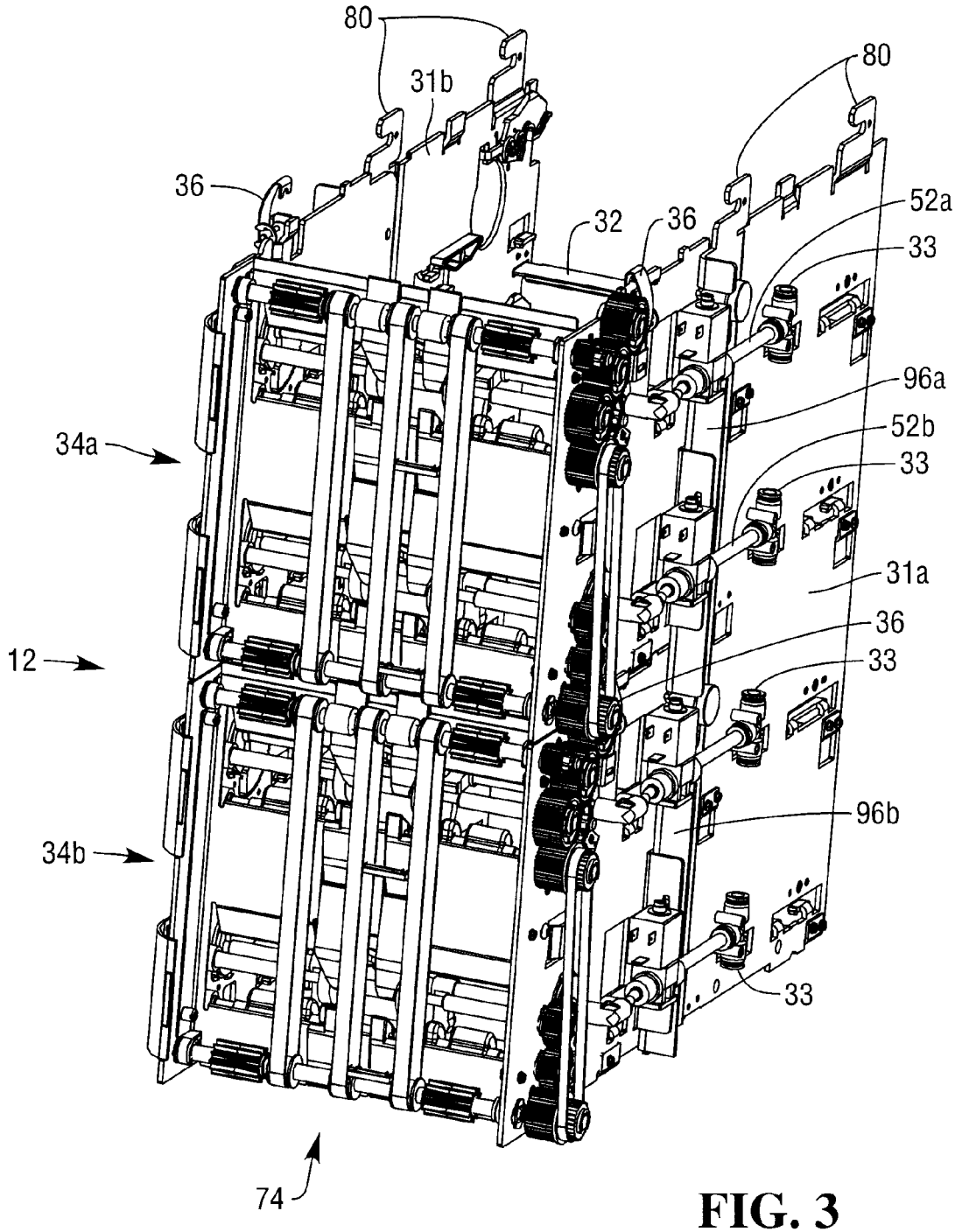
FIG. 3 is a schematic front right perspective view of part (a four-high pick unit) of the media dispenser of FIGS. 1 and 2.

Reference will now also be made to FIG. 3, is a schematic front right perspective view of the four-high pick unit 12 of the currency dispenser 10.

The four-high pick unit 12 comprises a frame 30 in the form of a pair of sheet metal sidewalls 31*a,b* maintained in spaced relation by metal bars 32 extending therebetween.

A vacuum feed pipe 33 (only a small part of this is visible in FIG. 3) extends down an inner surface of one of the sidewalls 31*a*. The vacuum feed pipe 33 couples to the vacuum source pipe (not shown).

The four-high pick unit 12 further comprises a pair of mutually coupled two-high removable picking assemblies 34*a,b* coupled to the frame 30.

One of these picking assemblies 34*a* is located above the other picking assembly 34*b*. The two picking assemblies 34*a,b* are identical to each other.

Each picking assembly 34 includes a pair of overcenter toggle latches 36 near the top of the picking assembly 34. Each picking assembly 34 also defines a pair of pick latch projections 38 located near the bottom of the picking assembly 34 and vertically aligned with the overcenter toggle latches 36. The banknote presenter unit 14 defines a pair of presenter latch projections (not shown, but identical to the pick latch projections 38). The presenter latch projections (not shown) align with, and are complementary to, the toggle latches 36, to allow the toggle latches 36 to be secured thereto.

Figure 4:
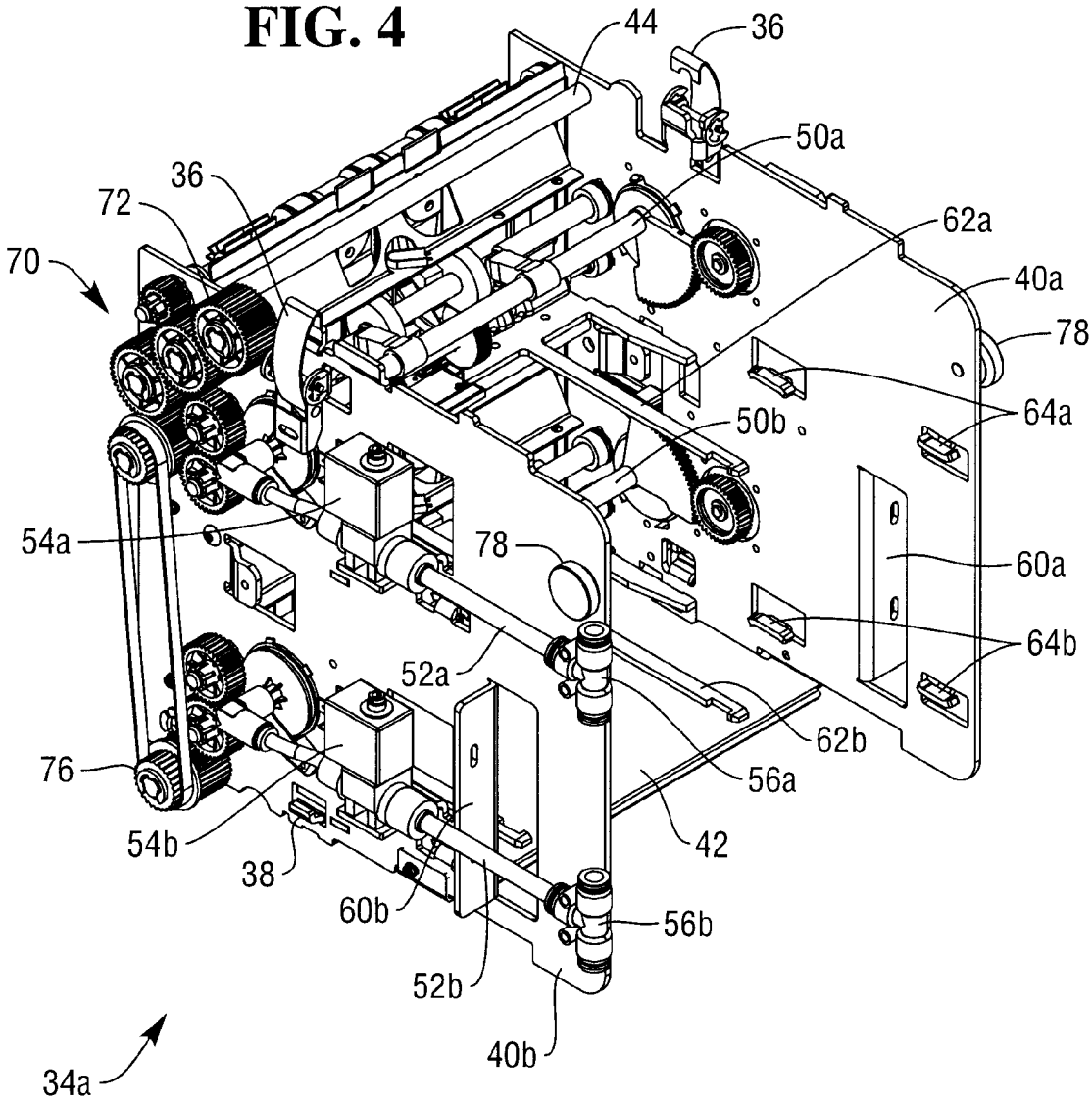
FIG. 4 is a schematic perspective view of a part (a removable two-high picking assembly) of the four-high pick unit of FIG. 3.
Figure 5:
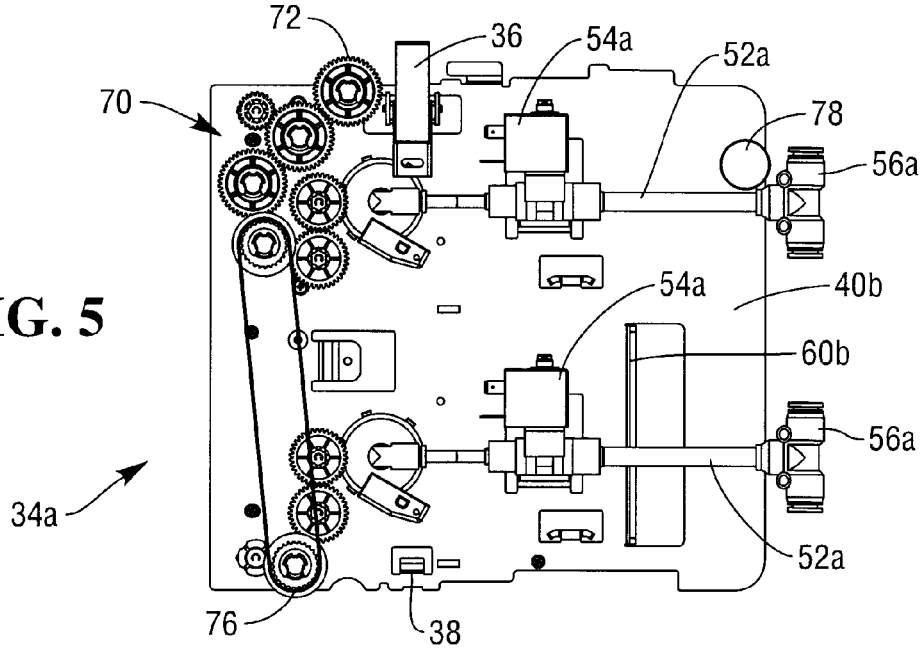
FIG. 5 is a schematic side view of the removable two-high picking assembly of FIG. 4.

Reference will now also be made to FIGS. 4 and 5, which illustrate one of the picking assemblies 34*a* in more detail.

The picking assembly 34*a* comprises a pair of sheet metal sidewalls 40*a*,40*b* mutually separated by a lower plate 42 and spacer bars 44. The picking assembly 34*a* further comprises an upper pick arm 50*a* and a lower pick arm 50*b*. Each of the pick arms 50*a,b* is hollow and in fluid communication with vacuum pipes 52*a,b*, spaced from the sidewall 40*b*, and extending from the pick arms 50*a,b* through solenoid operated valves 54*a,b* to vacuum couplings 56*a,b*. The vacuum couplings 56*a,b* are used to couple the vacuum pipes 52*a,b*, to the vacuum feed pipe 33 in the frame 30. As is known in the art, the solenoid operated valves 54*a,b* are used to apply and remove a vacuum (created by the vacuum generator) from the pick arms 50 to enable the pick arms 50 to remove a banknote from a currency cassette.

The sidewalls 40*a,b* define guide edges 60*a,b*. In this embodiment, the guide edges 60*a,b* comprise cut-away portions of the sheet metal sidewalls 40*a,b* that are bent outwards at approximately ninety degrees to the sidewall 40.

The picking assembly 34*a* also comprises an upper pair of tines 62*a* and a lower pair of tines 62*b* in addition to upper cassette guides 64*a* and lower cassette guides 64*b*. The upper cassette guides 64*a* serve to support and guide a currency cassette (not shown) as it is inserted into the upper portion of the picking assembly 34*a* until the upper pair of tines 62*a* enter slots in the currency cassette, thereby opening a window in the currency cassette through which banknotes can be picked by the pick arm 50*a*. Similarly, the lower cassette guides 64*b* serve to support and guide a currency cassette (not shown) as it is inserted into the lower portion of the picking assembly 34*a* until the lower pair of tines 62*b* enter slots in the currency cassette, thereby opening a window in the currency cassette through which banknotes can be picked by the pick arm 50*b*.

The picking assembly 34*a* further comprises a gear train 70 comprising a coupling gear 72 intermeshed with various other gears that rotate the upper and lower pick arms 50*a,b* and power a vertical transport 74 (comprising endless belts and skid plates) that moves picked banknotes upwards from each pick arm 50 towards the banknote presenter 14. The lowest gear in the gear train 70 (referred to herein as the power take-off gear 76) serves to transfer power to any picking assembly 34*b* located beneath the picking assembly 34*a*, as will be described in more detail below.

When the picking assembly 34*a* is mounted beneath the banknote presenter 14, then the coupling gear 72 engages with the transfer gear 22 and receives power therefrom.

The picking assembly 34*a* further comprises a pair of mushroom studs 78 mounted on opposing sidewalls 40*a,b* at an upper portion of the picking assembly 34*a*. The mushroom studs 78 operate as cam followers, as will be described in more detail below.

Figure 6:
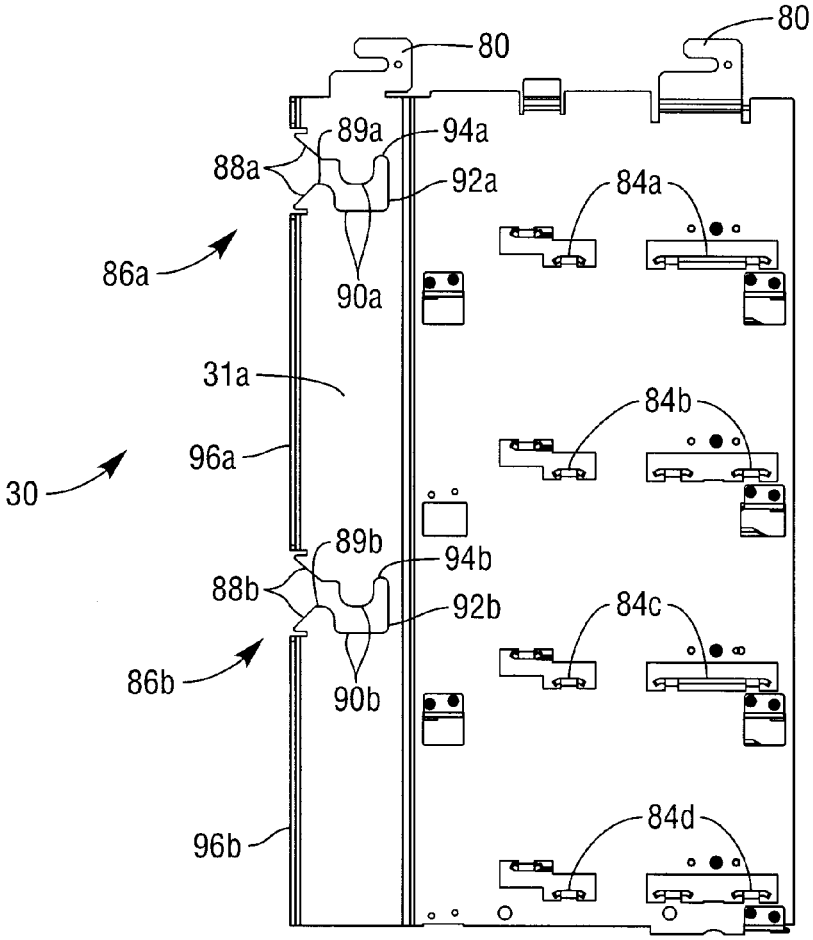
FIG. 6 is a schematic perspective view of another part (a frame) of the four-high pick unit of FIG. 3.

Reference will now be made to FIG. 6, which is a schematic perspective showing the frame 30 in more detail.

The frame's sidewalls 31*a,b* include mounting hooks 80 (which also define apertures for receiving screws) on an upper portion thereof, which can engage with studs 82 on the banknote presenter body 16, thereby enabling the frame 30 to be coupled to the banknote presenter 14.

The frame's sidewalls 31*a,b* define four sets of cassette mounting guides 84*a,b,c,d* on inner surfaces of the sidewalls 31*a,b*. These sets of cassette mounting guides 84 enable four currency cassettes to be separately racked into and out of the frame 30, and to align racked in currency cassettes with respective pick arms 50, window opening tines 62, and cassette guides 64.

The frame's sidewalls 31*a,b* also define upper and lower tortuous pathways 86*a,b*, which are identical and generally hook-shaped. Each tortuous pathway 86 includes a pair of wide entrance walls 88*a,b* for guiding the mushroom studs 78 therealong, a raised projection 89*a,b* beyond the wide entrance walls 88*a,b*, and narrow guide passage walls 90*a,b* beyond the raised projection 89*a,b* along which the mushroom studs 78 can travel. The narrow guide passage walls 90*a,b* define a lower stop position 92*a,b*, and an upper stop position 94*a,b* located vertically above the lower stop position 92*a,b*.

Each of the mushroom studs 78 defines a stem (not clearly visible on the drawings) dimensioned to be accommodated within the tortuous pathways 86, and a flange larger than the tortuous pathways 86 to retain the stem (not shown) within the tortuous pathways 86 while the mushroom stud 78 travels therealong.

The frame's sidewalls 31*a,b* also define upper and lower flanges 96*a,b* extending outwards from each sidewall 31. The upper flanges 96*a* provide surfaces against which the guide edges 60*a,b* of the picking assembly 34*a* abut when correctly aligned. Similarly, the lower flanges 96*b* provide surfaces against which guide edges 60*a,b* of the picking assembly 34*b* abut when correctly aligned. The upper and lower flanges 96*a,b* provide a detent (or stopping) function when mounting the picking assemblies 34*a,b* onto the frame 30, as will be described in more detail below.

A method of coupling the picking assembly 34*a* to the frame 30 will now be described with reference to FIGS. 7 to 13, which are schematic side views illustrating the picking assembly 34*a* and the frame 30 at various stages of the coupling process.

Figure 7:
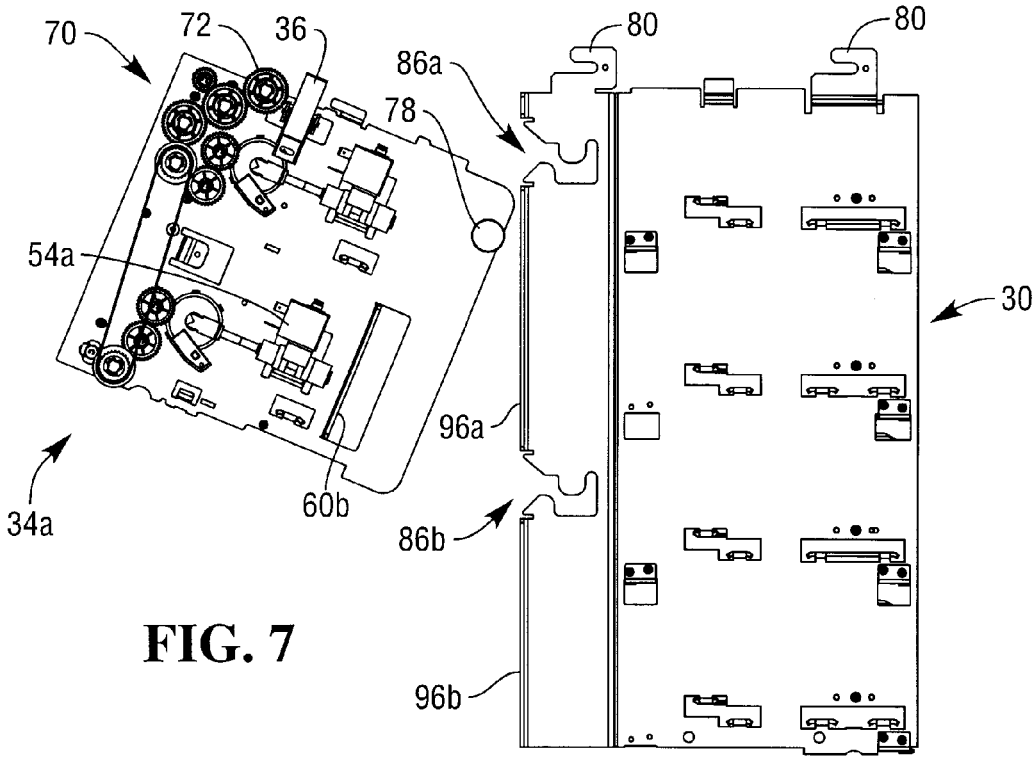
Figure 8:
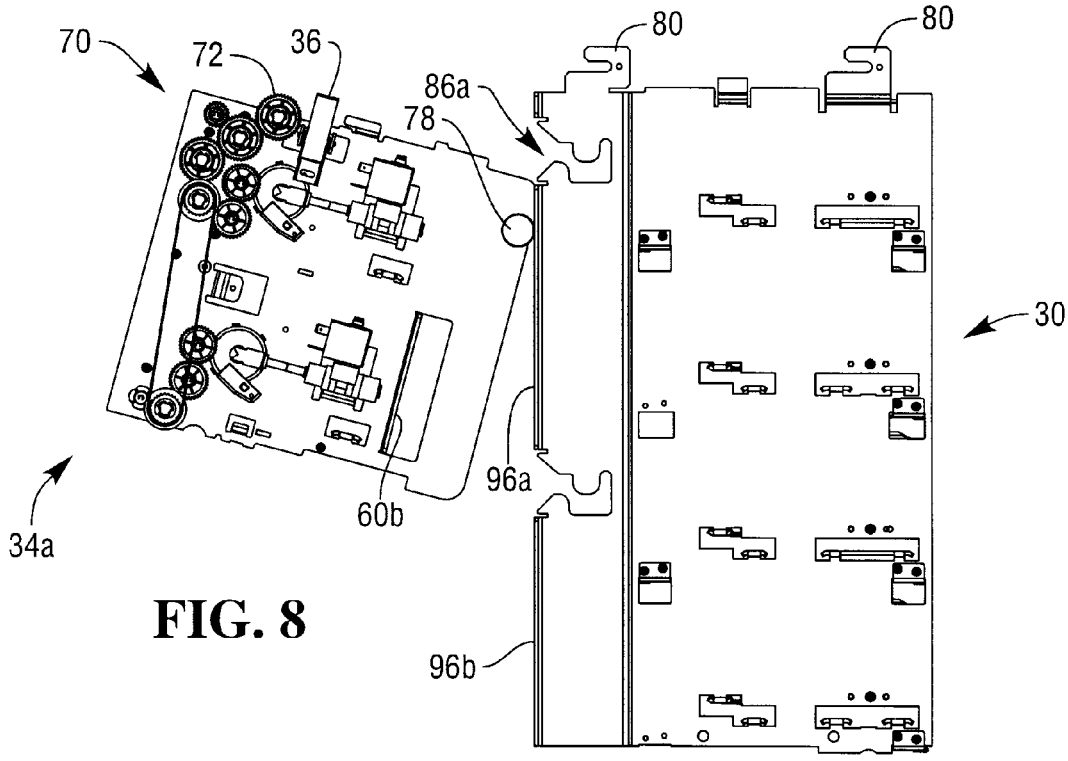

Initially, a service engineer (or other authorized person) lifts the picking assembly 34*a* towards the frame 30 (as illustrated in FIG. 7) until the mushroom studs 78 abut the upper flanges 96*a* (as illustrated in FIG. 8).

The service engineer then lifts the picking assembly 34*a* (while maintaining the mushroom studs 78 in contact with the upper flanges 96*a*) until the mushroom studs 78 are near to the entrance walls 88*a* of the frame 30, and then pivots the picking assembly 34*a* about the mushroom studs 78 until a lower portion of the guide edges 60*a,b* of the picking assembly 34*a* contact the upper flanges 96*a* (as illustrated in FIG. 9). At this point, the upper flanges 96*a* operate as a detent to prevent the picking assembly 34*a* from entering any further into the frame 30. This position is referred to as the initial alignment position.

From this initial alignment position, the service engineer lifts the picking assembly 34*a* until the mushroom studs 78 travel over the entrance walls 88*a* of the frame 30 (as shown in FIG. 10).

Figure 11:
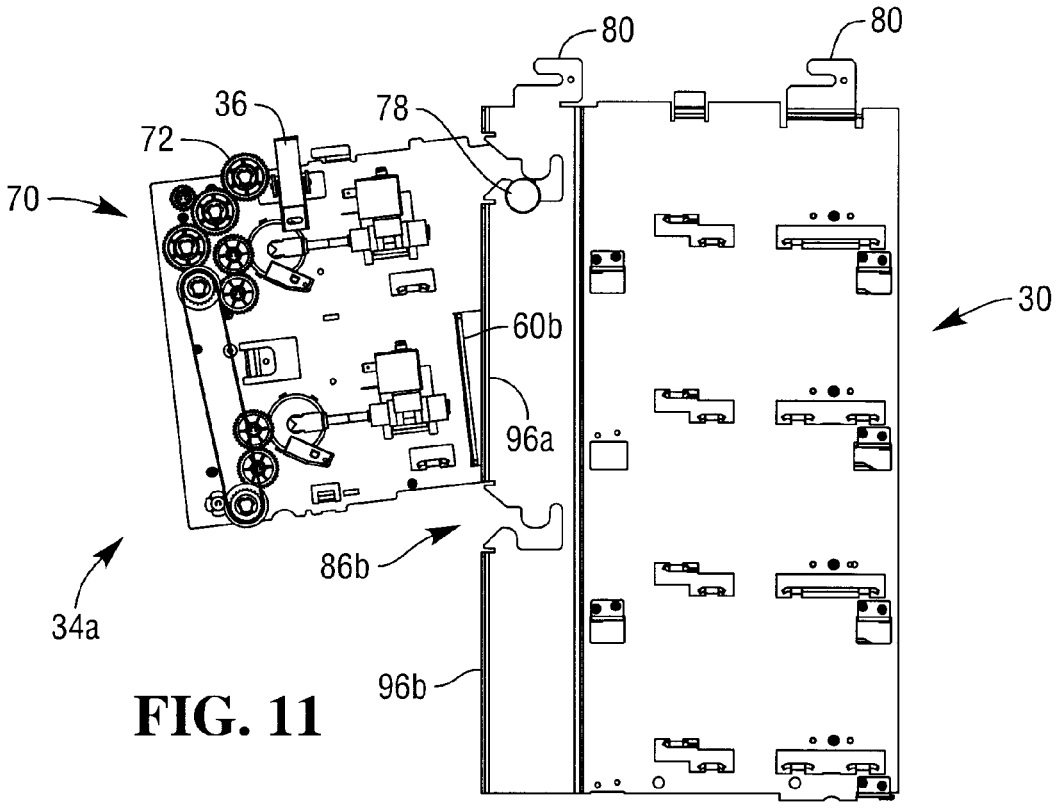

The service engineer pushes the picking assembly 34*a* forwards until the mushroom studs 78 travel over the raised projections 89*a* and then drop down into the narrow guide passages 90*a* (as illustrated in FIG. 11). This is referred to as the engagement position. When the picking assembly 34*a* is in the engagement position, the service engineer can release his/her grip on the picking assembly 34*a* because the mushroom studs 78 engage with the raised projections 89*a* and the narrow guide passages 90*a*, thereby preventing the picking assembly 34*a* from falling backwards or downwards. Furthermore, because a lower portion of the guide edges 60*a,b* of the picking assembly 34*a* is in contact with the upper flanges 96*a* when the picking assembly 34*a* is in the engagement position (as illustrated in FIG. 11), the picking assembly 34*a* cannot enter any further into the frame 30. At this stage, the service engineer can leave the picking assembly 34*a* hanging on the frame 30 and perform some other task, if desired.

Figure 12:
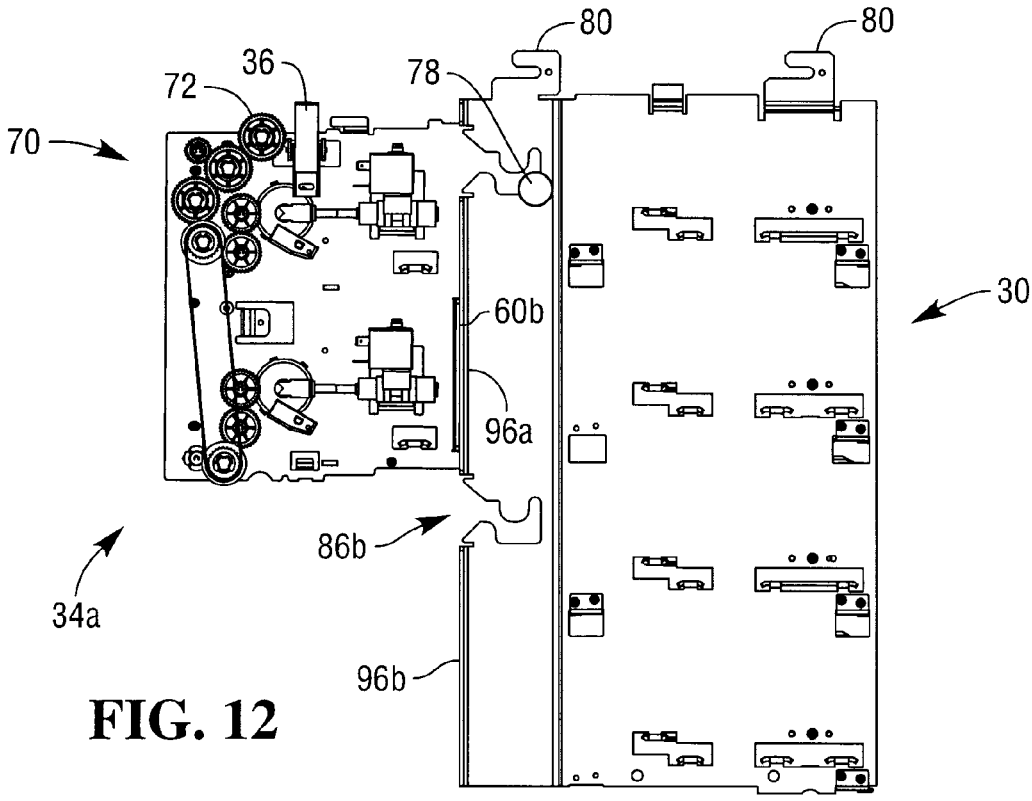

When the service engineer decides to complete the coupling between the picking assembly 34*a* and the frame 30, then the service engineer lifts the lower part of the picking assembly 34*a* (to pivot the picking assembly 34*a* upwards about the mushroom studs 78) until the guide edges 60*a,b* of the picking assembly 34*a* are flush with the upper flanges 96*a*. The service engineer then pushes the picking assembly 34*a* into the frame 30 until the mushroom studs 78 reach the lower stop position 92*a* (as illustrated in FIG. 12), which is referred to herein as the pre-engaged position.

Figure 13:
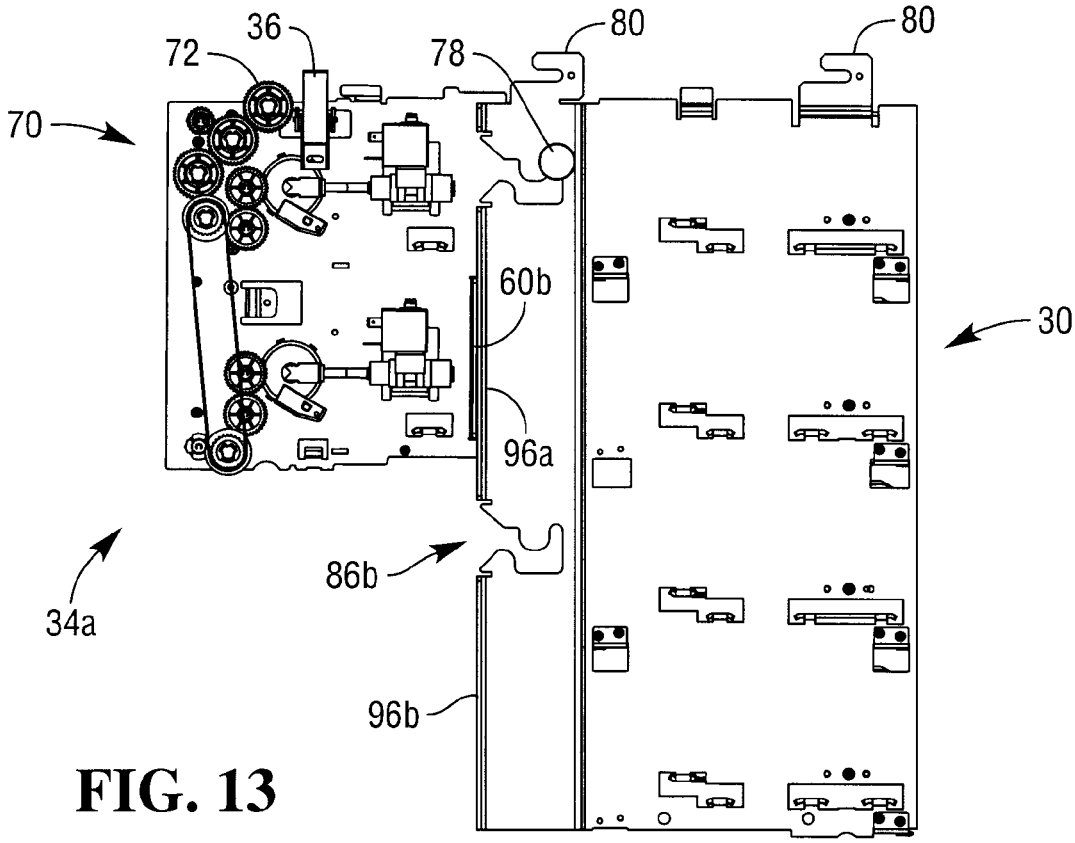

The service engineer then lifts the picking assembly 34*a* vertically from the pre-engaged position until the mushroom studs 78 travel from the lower stop position 92*a* to the upper stop position 94*a* (as illustrated in FIG. 13). This brings the coupling gear 72 on the picking assembly 34*a* into intermeshing engagement with the transfer gear 22 of the banknote presenter 14 so that power is transferred from the main gear 20 on the banknote presenter 14 to the picking assembly 34*a* via the hand gear 21, the transfer gear 22, and the coupling gear 72. This position is referred to herein as the engaged position.

In the engaged position, the toggle latches 36 can be coupled with the presenter latch projections (not shown) to secure the picking assembly 34*a* in place. In addition, apertures may be provided in the guide edges 60*a,b* and the upper flanges 96*a*, so that the apertures are in registration when the picking assembly 34*a* is in the engaged position. This allows screws or bolts to be used to further secure the picking assembly 34*a* to the frame 30.

The service engineer can then couple any required electrical connections (not shown) to the picking assembly 34*a*, and can also couple the vacuum feed pipe 33 on the frame 30 to the vacuum pipes 52*a,b* via the vacuum couplings 56*a,b*.

When the picking assembly 34*a* is in the engaged position, the second picking assembly 34*b* can be coupled in a similar manner. The main differences between coupling the picking assembly 34*a* and the picking assembly 34*b* are as follows. The toggle latches 36 on the picking assembly 34*b* will couple to the pick latch projections 38 on the lower part of the picking assembly 34*a* (instead of coupling to the banknote presenter latch projections (not shown)). The coupling gear 72 on the second picking assembly 34*b* will intermesh with the power take-off gear 76 of the first picking assembly 34*a* (instead of intermeshing with the transfer gear 22 of the banknote presenter 14).

To decouple the picking assemblies 34*a,b* from the frame 30, the procedure described above with reference to FIGS. 7 to 13 can be performed in reverse order, with the lowest picking assembly 34*b* being removed first.

Alternatively, the upper picking assembly 34*a* can be unlatched so that both picking assemblies 34*a,b* fall to the pre-engaged position (as illustrated in FIG. 12 for the upper assembly 34*a*). The service engineer can then unlatch the lower picking assembly 34*b* from the upper picking assembly 34*a* and remove the upper picking assembly 34*a* while leaving the lower picking assembly 34*b* in place. A new upper picking assembly 34*a* can then be installed to the pre-engaged position (following the process of FIGS. 7 to 12) and then latched to the lower picking assembly 34*b*. At this stage, the picking assemblies 34*a,b* are mutually coupled and located at the pre-engaged position. From the pre-engaged position, both picking assemblies 34*a,b* can be lifted as a single unit into the engaged position (FIG. 13) and secured there by the latches 36 on the upper picking assembly 34*a*.

It should now be appreciated that this embodiment has the advantage that a service engineer can remove part of a pick unit rather than an entire pick unit. In fact, for a four-high pick unit, the service engineer can remove part of a two-high pick module rather than the entire two-high pick module. Since the portion of the pick module that is removable (the picking assembly 34) contains the electro-mechanical devices, this is the portion that is most likely to need replacing. A service engineer should only rarely have to replace the frame 30. This embodiment splits a pick module into a removable picking assembly and a removable frame portion. The removable frame portion may be shared by multiple pick modules (that is, the same frame may be used by multiple picking assemblies), as in the above embodiment. This is practical because the frame should only rarely need replacing compared with the picking assemblies.

Various modifications may be made to the above described embodiment within the scope of the invention, for example, in other embodiments, the picking assembly may only include one pick arm, one pair of tines, and the like.

In other embodiments, the dispenser may include a one-high, a two-high, a three-high, a five-high, or a six-high pick unit, or any desired number of pick units.

In other embodiments, the dispenser may dispense media items other than banknotes.

In other embodiments, the frame may comprise multiple frame portions, one frame portion for each picking assembly.

In other embodiments, each picking assembly may only include one picking mechanism (or three or more picking mechanisms), rather than the two picking mechanisms per picking assembly described in the above embodiment.

In other embodiments, the presenter may be designed to allow both picking assemblies 34*a,b* to be coupled simultaneously (by coupling them together first using the toggle latches 36) then by lifting and advancing the combined picking assemblies 34*a,b* directly into the pre-engaged position, then vertically into the engaged position. Once in the engaged position, the toggle latches 36 on the first (upper) picking mechanism 34*a* can be secured to the presenter latch projections (not shown).

In such an embodiment, the combined picking assemblies 34*a,b* could be removed as a single unit by unlatching the toggle latches 36 from the presenter latch projections (not shown) (causing the combined picking assemblies 34*a,b* to drop from the engaged position to the pre-engaged position)

and pulling the combined picking assemblies 34*a,b* out and over the raised projections 89*a,b*, and then out of the frame 30 completely. This has the disadvantage that the service engineer has to bear the weight of the combined picking assemblies 34*a,b* during the de-coupling process, rather than the weight of just one of the picking assemblies 34*a,b*.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

What is claimed is:

1. A pick unit comprising:

a frame comprising opposing sidewalls, and defining: (i) one or more guides for receiving a currency cassette, (ii) a tortuous pathway including a raised projection, and (iii) a detent; and a picking assembly for removably coupling to the frame, the picking assembly including (i) a guide edge configured to abut the detent when the picking assembly is moved to an initial alignment position, (ii) a cam follower configured to align with the tortuous pathway when the removable picking assembly is moved from the initial alignment position to an engagement position, the tortuous pathway guiding and supporting the cam follower, and the raised projection retaining the cam follower in the frame when the picking assembly is in the initial alignment position, and (iii) a gear train configured to engage with an upper gear external to the pick unit when the removable picking assembly is moved to an engaged position at which the cam follower has reached an end of the tortuous pathway.

2. A pick unit according to claim 1, wherein the tortuous pathway is configured to move the gear train below the upper gear then upwards and into engagement with the gear train.

3. A pick unit according to claim 1, wherein the tortuous pathway is configured to support the removable picking assembly via the cam follower when the removable picking assembly is in the engagement position.

4. A pick unit according to claim 1, wherein the tortuous pathway comprises a hook shape.

5. A pick unit according to claim 1, wherein the removable picking assembly further comprises one or more latches for coupling to an external unit above the pick unit.

6. A pick unit according to claim 5, wherein the one or more latches comprise overcenter toggle latches.

7. A pick unit according to claim 1, wherein the frame defines apertures which, when the removable picking assembly is moved to the engaged position, are in registration with apertures on the removable picking assembly, thereby allowing threaded fixtures to secure the removable picking assembly to the frame.

8. A pick unit according to claim 1, wherein the cam follower comprises a mushroom stud.

9. A pick unit according to claim 1, wherein the removable picking assembly further comprises a vacuum pick arm, a vacuum pipe in fluid communication with the vacuum pick arm, and a vacuum coupling for connecting the vacuum pipe to a frame pipe.

10. A pick unit according to claim 1, wherein the removable picking assembly further comprises a plurality of vacuum pick arms.

11. A media dispenser including the pick unit according to claim 1.

12. A self-service terminal including the media dispenser according to claim 11.

13. A pick unit comprising:

a frame comprising opposing sidewalls, and defining: (i) one or more guides for receiving a currency cassette, (ii) a tortuous pathway, and (iii) a detent; and a picking assembly for removably coupling to the frame, the picking assembly including (i) a guide edge configured to abut the detent when the picking assembly is moved to an initial alignment position, (ii) a cam follower configured to align with the tortuous pathway when the removable picking assembly is moved from the initial alignment position to an engagement position, the tortuous pathway guiding and supporting the cam follower, and (iii) a gear train configured to engage with an upper gear external to the pick unit when the removable picking assembly is moved to an engaged position at which the cam follower has reached an end of the tortuous pathway;

wherein the tortuous pathway is configured to move the gear train below the upper gear then upwards and into engagement with the gear train.

14. A pick unit comprising:

a frame comprising opposing sidewalls, and defining: (i) one or more guides for receiving a currency cassette, (ii) a tortuous pathway, and (iii) a detent; and a picking assembly for removably coupling to the frame, the picking assembly including (i) a guide edge configured to abut the detent when the picking assembly is moved to an initial alignment position, (ii) a cam follower configured to align with the tortuous pathway when the removable picking assembly is moved from the initial alignment position to an engagement position, the tortuous pathway guiding and supporting the cam follower, (iii) a gear train configured to engage with an upper gear external to the pick unit when the removable picking assembly is moved to an engaged position at which the cam follower has reached an end of the tortuous pathway, and (iv) a plurality of vacuum pick arms.

* * * * *